United States Patent [19]

Huchinson

[11] Patent Number: 4,650,427

[45] Date of Patent: Mar. 17, 1987

[54] SPRING ACTION BOAT MOTOR SUPPORT

[76] Inventor: Sam E. Huchinson, 4877 Adams Ave., Baton Rouge, La. 70806

[21] Appl. No.: 888,270

[22] Filed: Jul. 21, 1986

Related U.S. Application Data

[63] Continuation of Ser. No. 679,499, Dec. 7, 1984, abandoned.

[51] Int. Cl.[4] ..... B63H 21/26

[52] U.S. Cl. ..... 440/55; 248/351; 248/642; 248/354.1; 248/354.5; 440/900; 267/170

[58] Field of Search ..... 440/53, 55, 61, 900; 114/343, 364; 248/640, 641, 642, 643, 351, 354.1, 354.3, 354.5, 354.6; 280/414.1, 414.3, 482; 267/170, 177, 178, 71, 136; 24/523, 524, 525, 486, 135 L

[56] References Cited

U.S. PATENT DOCUMENTS

| | | | |
|---|---|---|---|
| 1,285,517 | 11/1918 | White | 24/569 X |
| 2,491,246 | 12/1949 | Bloomfield | 248/351 |
| 2,939,670 | 6/1960 | Anderson | 248/351 |
| 2,977,084 | 3/1961 | Brown et al. | 248/642 X |
| 2,981,222 | 4/1961 | Cunefare | 440/62 |
| 3,011,800 | 12/1961 | Mitsuyasu | 280/482 |
| 3,173,644 | 3/1965 | Burfiend | 267/170 X |
| 3,941,344 | 3/1976 | Paterson | 248/351 |
| 4,501,561 | 2/1985 | Speelman | 440/61 |

*Primary Examiner*—Joseph F. Peters, Jr.
*Assistant Examiner*—Paul E. Salmon
*Attorney, Agent, or Firm*—William D. Kiesel; Robert C. Tucker

[57] ABSTRACT

An adjustable boat motor support means attachable to the boat transom or trailer and motor to prevent damage to the boat transom during transporting which is caused by the motor kicking up or shaking during hauling on a trailer is provided, comprising a vertically expandable first assembly pivotally mounted at one end to the boat transom and having a seating member at its opposite end in which the lower motor housing can rest, and a motor attachment assembly vertically, adjustably attachable at one end to the first assembly and attachable at its opposite end to the lower motor housing.

3 Claims, 2 Drawing Figures

SPRING ACTION BOAT MOTOR SUPPORT

This is a continuation of co-pending application Ser. No. 679,499, filed on Dec. 7, 1984, now abandoned.

BACKGROUND OF THE INVENTION

1. Field of the Invention.

This invention relates to apparatus for securing a boat motor in fixed position during trailering.

2. Prior Art.

In order to protect a boat motor's propeller and lower housing during trailering, it is desirable to tilt the lower housing upward in order to further remove it from the road. Most motors today have a tilting mechanism which can secure the lower housing in an upward tilt position. These mechanisms are satisfactory so long as the trailer does not hit a bump or dip in the road. Unfortunately, this occurs often, resulting in the lower motor housing breaking the tilting mechanism as well as causing damage to itself or to the propeller. Another major problem is vibrational damage to the vibration of the boat motor during trailering. Because of the seriousness of this problem, many devices have been devised to try to overcome this type of problem, e.g.:

| U.S. Pat. No. | INVENTOR | ISSUED | TITLE |
|---|---|---|---|
| 1,285,517 | White | 11/19/18 | BOW REST AND CLAMPING DEVICE |
| 2,491,246 | Bloomfield | 12/13/49 | DOORSTOP |
| 2,782,052 | Albrecht, et al | 02/19/57 | BOAT TRAILER ATTACHMENT FOR SUPPORT OF BOAT POWER MEANS |
| 2,901,267 | Holsclaw | 08/25/59 | OUTBOARD MOTOR SUPPORT |
| 2,939,670 | Anderson | 06/07/60 | OUTBOARD MOTOR SUPPORTING TRAILER ATTACHMENT |
| 2,977,084 | Brown, et al | 03/28/61 | OUTBOARD MOTOR TILT-UP RACK |
| 2,981,222 | Cunefare | 04/25/61 | STEERING DEVICE FOR OUTBOARD MOTOR |
| 3,011,800 | Mitsuyasu | 12/05/61 | TOW BAR |
| 3,096,959 | Wagner | 07/09/63 | OPERABLE MOUNTING MEANS FOR OUTBOARD MARINE MOTOR |
| 3,173,644 | Burfiend | 03/16/65 | SAFETY PROP |
| 3,416,759 | Arnett | 12/17/68 | OUTBOARD MOTOR SUPPORT BRACKET MEANS |
| 3,693,576 | Driscoll | 09/26/72 | OUTBOARD MOTOR STABILIZER |
| 3,941,344 | Paterson | 03/02/76 | MOTOR SUPPORT |
| 4,125,236 | Landwerlen | 11/14/78 | TRANSOM SAVER |
| 4,331,431 | Estes | 05/25/82 | TRANSOM SAVER |
| 4,501,561 | Speelman | 02/26/85 | BRACE DEVICE FOR MOTOR BOAT DRIVE UNIT |

However, these devices have not provided the ease of attachment, the simplicity of construction, or the necessary securement desired.

SUMMARY OF THE INVENTION

Therefore, it is an object of this invention to provide a device for easily securing a boat motor in a tilt position during trailering that is simple in construction, yet provides the necessary support to prevent the motor from kicking upward if the trailer hits a bump or hole in the road.

These and other objects and advantages of this invention shall become apparent from the ensuing descriptions of the invention.

Accordingly, an adjustable boat motor support means attachable to the boat transom or trailer and motor to prevent the motor from kicking up during hauling on a trailer is provided comprising a vertically expandable first assembly pivotly mounted at one end to the boat transom and having a seating member at its opposite end in which the lower motor housing can rest, and a motor attachment assembly vertically adjustably attachable at one end to the first assembly and attachable at its opposite end to the lower motor housing.

PREFERRED EMBODIMENTS OF THE INVENTION

Figure 1:
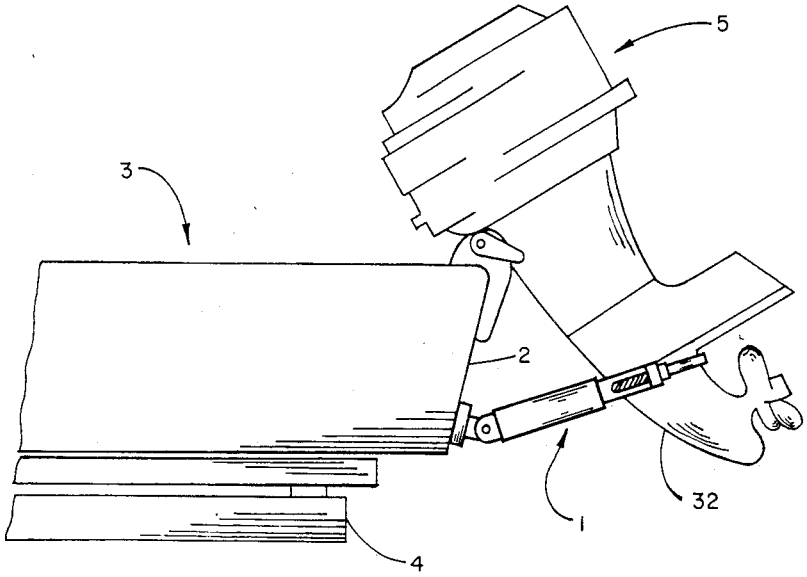
FIG. 1 is a side view of the support means attached to the boat transom and motor.
Figure 2:
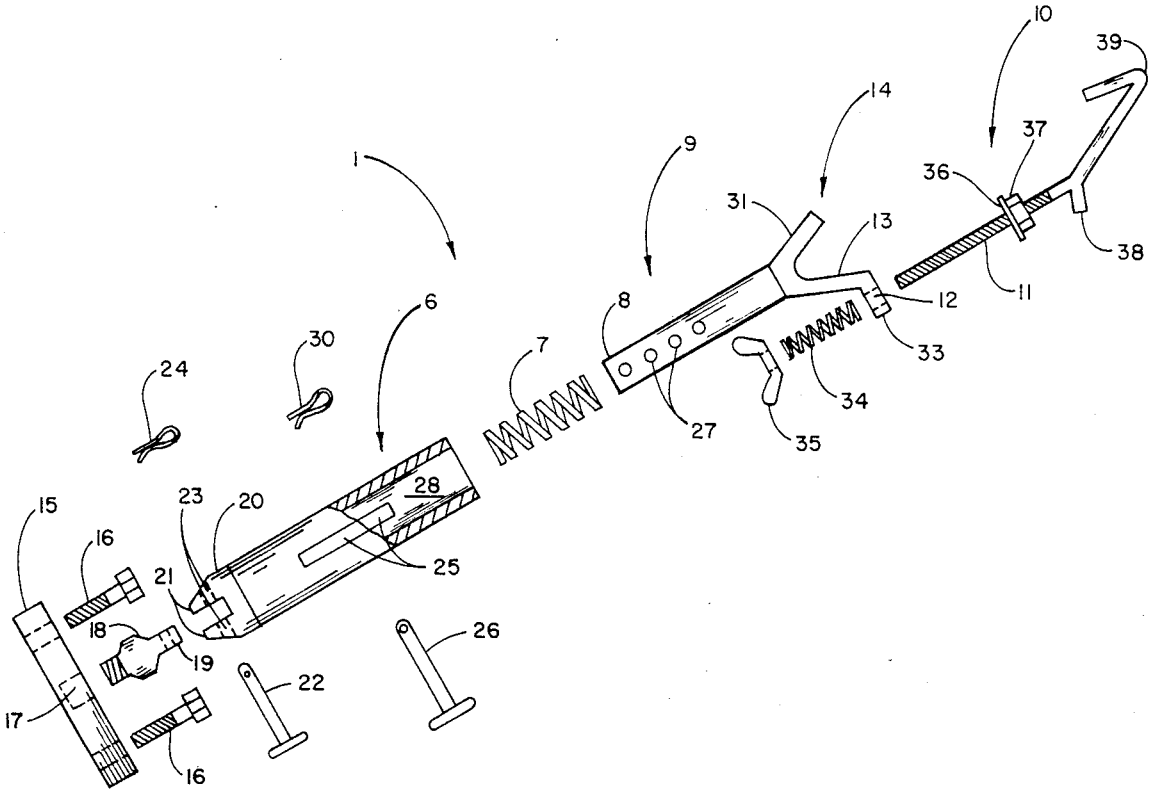
FIG. 2 is an exploded view of a preferred embodiment of the invention.

Referring now to the figures, a preferred embodiment of support means 1 is shown attached to transom 2 of boat 3 mounted on trailer 4 wherein motor 5 is tilted in position for trailering.

More particularly support means 1 comprises an expandable first assembly having a hollow lower tubular shaft 6 into which spring 7 can fit along with the lower end 8 of upper tubular shaft 9. It also comprises a motor assembly, having rod member 10 whose threaded end 11 extends through opening 12 of tine 13 of cradle member 14 which is attached and extends outward from shaft 9.

In a preferred embodiment, bar 15 is fixed mounted by bolts or screws 16 to the lower section of transom 2. Bar 15 is further provided with a threaded opening 17 into which is screwed plug means 18 having a flat shoulder member 19. Lower tubular shaft 6 is provided with a plugging end member 20 having a parallel pair of ear members 21 which fit about pin 22 that passes through alignable openings 23 in ear members 21 and end member 20 and held in position by snap-on ring 24.

In a more preferred embodiment, shaft 6 with parallel, vertical slots 25 which permit pin 26 to extend through one of openings 27 of shaft 9 when lower end 9 is positioned in lower tubular shaft cavity 28. Pin 26 is held in place by the expansion force of compressed spring 7 that is positioned in cavity 28 between plugging end member 20 and lower end 8. In a more preferred embodiment pin 26 can also be held in slots 25 by snap-on ring 30.

In a preferred embodiment, cradle member 14 has two tines 13 and 31 that form a V-shaped piece into which the lower motor assembly housing 32 can be positioned. In this embodiment it is preferred that the extending end of tine 13 having an offset shoulder member 33 in which opening 12 extends in order not to interfere with the positioning of housing 32.

It is preferred that a second spring 34 be placed over rod 10 in order to provide an expansion force to help prevent wing nut 35 from unscrewing during trailering. In this embodiment, washer 36 and bolt 37 are atached to threaded end 11 to be positioned between shoulder member 33 and pulling member 38 which extends outward from rod 10 a sufficient distance to provide a means to grip rod member 10. Finally, rod 10 is provided with a J-shaped end 39 which hooks around the opposite side of lower motor assembly housing 32 that is positioned between tines 13 and 31.

Thus in operation, lower tubular shaft 6 is pivotly mounted to transom 2 and upper tubular shaft 9 is pushed into lower tubular shaft 6 so that cradle member 14 can be positioned below lower motor assembly housing 32. Then one allows spring 07 to push shaft 9 upward until lower motor assembly housing 32 is in position between tines 13 and 31. Pin 26 is then slipped through slots 25 and one of openings 27 and snap-on ring 30 attached to pin 26. Finally, elbow 39 is positioned on the lower motor housing 32 and tightened in position by wing nut 37 or bolt 35, thus secured motor 5 is prevented from vibrating or kicking up during trailering.

There are of course, other obvious alternate preferred embodiments not specifically shown such as connecting the motor support to the trailer rather then the boat transom, but which are intended to be included within the scope of the invention as defined by the following claims.

What I claim is:

1. A boat motor support apparatus attachable to a boat transom and a boat motor which comprises:

(a) a first assembly comprising:

(i) a hollow first shaft having one plugged and pivotally mountable to said boat transom, said first shaft having aligned opposite openings extending partially along and parallel to the vertical axis of said first shaft, (ii) a coiled spring sized to fit into the cavity of said shaft, (iii) a second shaft having one end sized to be insertable in said cavity and abuttable against one end of said spring, said second shaft having a series of openings extending therethrough along the vertical axis of said second shaft, at least one of said series of openings being alignable with said aligned opposite openings, said second shaft having a seating member attached at its opposite end shaped to receive the lower housing of said boat motor, and (iv) means extendable through said aligned opposite openings and said one of said series of openings, (b) a second assembly comprising:

(i) a J-shaped rod having a straight section sized to pass through an opening of an offset shoulder member attached to said seating member, said straight section having a stop means attached thereto, (ii) a coil spring fittable about said straight section and abuttable between said stop means and said shoulder member, and (iii) rod securing means attachable to the end of said straight section extending through said opening to secure said J-shaped rod in position.

2. A boat motor support apparatus according to claim 1 wherein said rod securing means is attachable at different distances from said end of said straight section.

3. A boat motor support apparatus according to claim 1 wherein said end of said straight section is threaded and said rod securing means is a nut.

* * * * *